US008300850B2

(12) United States Patent
Cho et al.

(10) Patent No.: US 8,300,850 B2
(45) Date of Patent: Oct. 30, 2012

(54) READ-OUT CIRCUIT WITH HIGH INPUT IMPEDANCE

(75) Inventors: Min Hyung Cho, Daejeon (KR); Yi Gyeong Kim, Daejeon (KR); Jae Won Nam, Pohang-si (KR); Jong Kee Kwon, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 615 days.

(21) Appl. No.: 12/511,361

(22) Filed: Jul. 29, 2009

(65) Prior Publication Data

US 2010/0158277 A1 Jun. 24, 2010

(30) Foreign Application Priority Data

Dec. 19, 2008 (KR) ..... 10-2008-0130418

(51) Int. Cl.
*H04R 3/00* (2006.01)

(52) U.S. Cl. ..... 381/113; 381/111; 381/121; 381/122; 381/120; 330/260; 330/265

(58) Field of Classification Search ..... 381/91–92, 381/95, 122, 111, 113, 121, 120; 330/253, 330/260, 265
See application file for complete search history.

(56) References Cited

U.S. PATENT DOCUMENTS

| | | | | |
|---|---|---|---|---|
| 7,149,317 | B2 | 12/2006 | Lafort | |
| 7,276,969 | B1 * | 10/2007 | Aram | 330/253 |
| 2007/0009111 | A1 | 1/2007 | Stenberg et al. | |
| 2009/0108931 | A1 * | 4/2009 | Wagt | 330/129 |
| 2010/0135508 | A1 * | 6/2010 | Wu | 381/122 |

FOREIGN PATENT DOCUMENTS

| | | | |
|---|---|---|---|
| EP | 0444466 | B1 | 8/1996 |
| KR | 1020010005556 | A | 1/2001 |
| KR | 1020010081014 | A | 8/2001 |
| KR | 100733288 | B1 | 6/2007 |
| WO | WO 99/38020 | A1 | 7/1999 |
| WO | WO 00/29821 | A1 | 5/2000 |
| WO | WO 2005/076466 | A1 | 8/2005 |

OTHER PUBLICATIONS

Michael W. Baker et al., "A Low-Power High-PSRR Current-Mode Microphone Preamplifier," IEEE Journal of Solid-State Circuits, Oct. 2003, pp. 1671-1678, vol. 38, No. 10, IEEE.

S.A. Jawed et al., "A Switched Capacitor Interface for a Capacitive Microphone," 2006, pp. 385-388, IEEE.

* cited by examiner

*Primary Examiner* — Disler Paul

(57) ABSTRACT

Provided is a read-out circuit that is connected to a microphone and configured to linearly amplify a current signal generated by the microphone and output the amplified current signal. The read-out circuit includes an amplification unit and a feedback resistor. The amplification unit has an amplification gain between 0 and 1. The feedback resistor is connected between input and output terminals of the amplification unit. As the amplification gain of the amplification unit becomes closer to 1, an input impedance becomes higher. A preamp of the read-out circuit can have a high input impedance due to the amplification gain, and the read-out circuit can be manufactured using a CMOS process.

6 Claims, 3 Drawing Sheets

READ-OUT CIRCUIT WITH HIGH INPUT IMPEDANCE

CROSS-REFERENCE TO RELATED APPLICATION

This application claims priority to and the benefit of Korean Patent Application No. 10-2008-0130418, filed Dec. 19, 2008, the disclosure of which is incorporated herein by reference in its entirety.

BACKGROUND

1. Field of the Invention

The present invention relates to a read-out circuit used for a capacitor-type microphone, and more specifically, to a read-out circuit having a high input impedance, which is applicable to a complementary metal oxide semiconductor (CMOS) process.

2. Discussion of Related Art

In recent years, there has been an explosive increase in the demand for digital apparatuses which receive speech signals such as various mobile phones. Owing to the increased demand for such digital apparatuses, circuit devices, for example, capacitor-type microphones used for the digital apparatuses and preamps configured to amplify output signals of the microphones, have become strongly relied upon.

Digital apparatuses are showing a tendency to be smaller, and thus it is becoming increasingly necessary to downscale circuits used for the digital apparatuses. This has led to a strong need for a System on Chip (SoC) technique capable of integrating circuits on a single chip.

Above all, there is a great need to miniaturize and integrate read-out circuits configured to convert speech signals into electrical signals in digital apparatuses, such as mobile phones.

In general, a read-out circuit may receive a speech signal through a microphone and convert the speech signal into an electrical signal. The microphone may convert the received speech signal into a current signal using a variable capacitance. A microphone using a variable capacitor is referred to as a capacitor-type microphone. Hereinafter, a read-out circuit, which is connected to a capacitor-type microphone and converts an input speech signal into an electrical signal, will be described with reference to FIG. 1(*a*) to (*c*).

FIG. 1(*a*) to (*c*) show diagrams showing equivalent models of a conventional capacitor-type microphone and read-out circuit.

Referring to FIG. 1(*a*), the microphone 120 may include a variable capacitor 121, which varies a capacitance in response to a speech signal and generates a current signal. The read-out circuit 110 may include a load resistor RL and a preamp (not shown). The load resistor RL may receive the current signal generated by the variable capacitor 121 and output a voltage signal through an output node 101. The preamp may be connected to the output node 101 and linearly vary the voltage signal.

In this case, the microphone 120 may be an electrical equivalent model of a capacitor-type microphone and may have an intrinsic capacitance Co and a variable capacitance ΔC. The variable capacitance ΔC may be used to generate an electrical signal in response to a speech signal.

The load resistor $R_L$ may be used to convert the current signal generated according to the capacitance ΔC into the voltage signal. Here, the current signal generated by the variable capacitor 121 can be expressed as shown in Equation 1:

$$I_C = \frac{dq}{dt} = V_{DC} \cdot \Delta C_P \cdot 2\pi f \cdot \cos(2\pi f t). \tag{1}$$

where $I_C$ denotes a current generated by the microphone 120, $V_{DC}$ denotes a voltage applied between both terminals of the variable capacitor 121 of the microphone 120, $\Delta C_P$ denotes a capacitance varied in response to a speech signal, and "f" denotes a frequency of the speech signal.

The current generated by the microphone 120 may be converted into a peak output voltage $V_{OPeak}$, which is expressed in Equation 2, through the output node 101.

$$V_{OPeak} = I_{CPeak} \cdot \left[R_L // \frac{1}{2\pi f \cdot C_O}\right] = \frac{V_{DC} \cdot \Delta C_P \cdot 2\pi f \cdot R_L}{1 + 2\pi f \cdot C_O \cdot R_L}. \tag{2}$$

The current signal generated by the variable capacitor 121, which is expressed in Equation 1, may be proportional to a direct current (DC) bias voltage $V_{DC}$ applied between both terminals of the variable capacitor 121, the capacitance, and especially, the frequency of the input speech signal.

The capacitance varied by the microphone 120 may be proportional to the intensity of the input speech signal. However, on analysis of the characteristics of the voltage signal $V_{OPeak}$ obtained by the load resistor $R_L$ shown in Equation 2, a pole is formed in a frequency of $C_o \times R_L$ by the load resistor $R_L$. After the frequency in which the pole is formed, the intensity of an output voltage is proportional to the intensity of an input speech signal irrespective of the frequency of the input speech signal. This characteristic may be obtained using the preamp of the microphone 120.

The preamp of the microphone 120 should linearly vary a voltage signal in a frequency range of about 20 Hz to 20 KHz, which corresponds to the frequency range of a speech signal. Accordingly, in consideration of an intrinsic capacitance $C_o$ of a typical capacitor-type microphone, the preamp of the microphone 120 requires a load resistor $R_L$ having a high input impedance of several GΩ or higher.

In order to obtain a high input impedance of several GΩ or higher, a resistor having a resistance of several GΩ or higher has been conventionally formed using an additional process. Also, in order to input a voltage signal output by the resistor, a preamp using a junction field effect transistor (JFET) is formed using an additional process.

However, due to various advantages, such as cost reduction, miniaturization, and low power, an integration process has recently involved a standard CMOS process. However, integrating a read-out circuit of a conventional microphone using a standard CMOS process is impossible because a resistor having a resistance of several GΩ or higher and a preamp using a JFET are formed using additional processes other than the standard CMOS process. In other words, integrating the read-out circuit with a digital processing block connected to a rear terminal of the read-out circuit on a single chip is impracticable, thereby precluding downscaling of the conventional microphone and increasing manufacturing cost.

SUMMARY OF THE INVENTION

The present invention is directed to a read-out circuit in which a preamp having high input impedance is formed using a complementary metal oxide semiconductor (CMOS) process to enable miniaturization and integration of the read-out circuit.

One aspect of the present invention provides a read-out circuit connected to a microphone, and configured to linearly amplify a current signal generated by the microphone and convert into the output voltage signal. The read-out circuit includes: an amplification unit having an amplification gain between 0 and 1; and a feedback resistor connected between input and output terminals of the amplification unit, wherein, as the amplification gain of the amplification unit becomes closer to 1, an input impedance becomes higher.

The amplification unit may include a unity-gain amplifier using an operational amplifier having a predetermined amplification gain. The operational amplifier may include a positive input terminal, a negative input terminal, and an output terminal, and the output terminal of the operational amplifier may be connected to the negative input terminal thereof so that the amplification unit can have an amplification gain between 0 and 1.

The amplification gain of the unity-gain amplifier may satisfy:

$$Aeq = \frac{A_{opamp}}{1 + A_{opamp}}$$

where $A_{eq}$ is an amplification gain of the unity-gain amplifier, and $A_{opamp}$ is an amplification gain of the operational amplifier.

The amplification gain of the operational amplifier may be 10 or more.

The input impedance may satisfy:

$$Req = Ro \cdot \frac{1}{1 - Aeq}$$

where $R_{eq}$ is an input impedance, $R_o$ is a resistance of the feedback resistor, and $A_{eq}$ is an amplification gain of the amplification unit, which is between 0 and 1.

The amplification unit and the feedback resistor may be manufactured using a standard CMOS process.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF EMBODIMENTS

Figure 1:
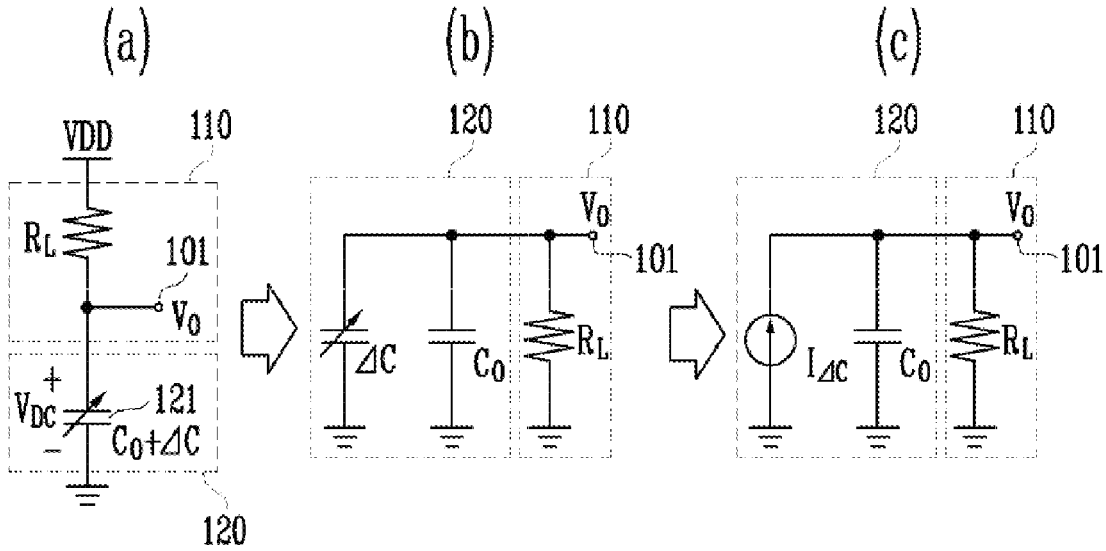
FIG. 1 (PRIOR ART)
FIG. 1 is a diagram showing an equivalent circuit model of a conventional capacitor-type microphone read-out circuit.

The present invention will be described more fully hereinafter with reference to the accompanying drawings, in which exemplary embodiments of the invention are shown. This invention may, however, be embodied in many different forms and should not be construed as being limited to the embodiments set forth herein. Rather, these embodiments are provided so that this disclosure is thorough and complete and fully conveys the concept of the invention to those skilled in the art. For simplicity, identical reference numerals are used, where possible, to designate identical elements that are common to the figures. Also, when it is determined that a detailed description of related known functions or constructions makes the concept of the invention unnecessarily unclear, the detailed description will be omitted.

The present invention proposes a preamp circuit with high input impedance so that a read-out circuit for a microphone can be embodied using a standard complementary metal oxide semiconductor (CMOS) process.

Hereinafter, it should be understood that a high input impedance used in the present invention is several GΩ or higher.

Figure 2:
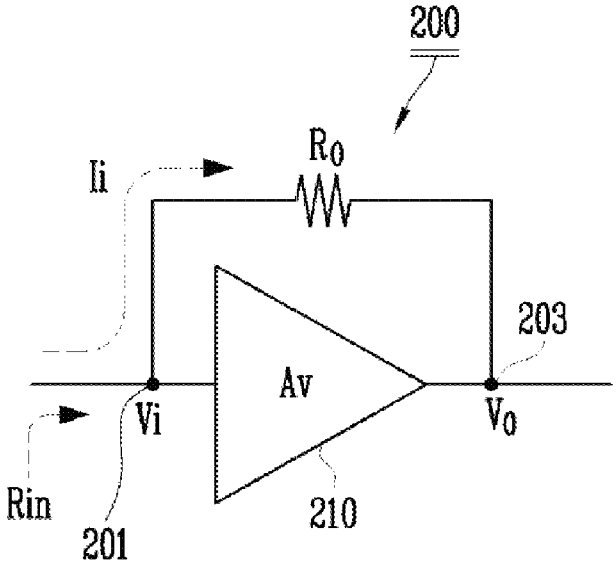
FIG. 2 is a circuit diagram of an amplifier using a feedback resistor.

FIG. 2 is a circuit diagram of an amplifier 200 using a feedback resistor, which is an amplifier commonly used in a CMOS circuit.

Referring to FIG. 2, the amplifier 200 may include an amplification unit 210 and a feedback resistor $R_o$. The amplification unit 210 may have an amplification gain of $A_v$. The feedback resistor $R_o$ may be provided between an input node 201 and an output node 203 of the amplification unit 210.

An input impedance $R_{in}$ of the amplifier 200 may be expressed as in Equation 3:

$$Rin = \frac{Vi}{Ii} = Ro \cdot \frac{1}{1 - Av} \tag{3}$$

where $V_i$ denotes an input voltage, $I_i$ denotes a current supplied to the input node 201 of the amplifier 200, and $A_v$ denotes an amplification gain of the amplification unit 210.

As can be seen from Equation 3, the input impedance $R_{in}$ varies with the amplification gain $A_v$.

First, when the amplification gain $A_v$ is less than 0, the input impedance $R_{in}$ is lower than the feedback resistance $R_o$. Second, when the amplification gain $A_v$ is greater than 1, the input impedance $R_{in}$ has a negative value. Third, when the amplification gain $A_v$ is between 0 and 1, the input impedance $R_{in}$ is higher than the feedback resistance $R_o$.

Here, as the amplification gain $A_v$ becomes closer to 1 between 0 and 1, the input impedance $R_{in}$ becomes higher. For example, when the amplification gain $A_v$ is 0.9, the input impedance $R_{in}$ has a value of $10 \times R_o$. Also, when the amplification gain $A_v$ is 0.999, the input impedance $R_{in}$ has a value of $1000 \times R_o$. In other words, when the amplification gain $A_v$ is close to but less than 1, a high input impedance may be obtained using a low feedback resistance $R_o$.

In order to obtain high input impedance using the above-described characteristics, the present invention proposes a read-out circuit that has an amplification gain, which is less than 1 and closer to 1, and is applicable to a standard CMOS process. For reference, a typical standard CMOS process enables formation of an amplifier with a resistance of about 1 MΩ or lower and an amplification gain of about $10^5$ or less.

Hereinafter, a read-out circuit having high input impedance, which is applicable to a standard CMOS process, will be described with reference to FIG. 3.

Figure 3:
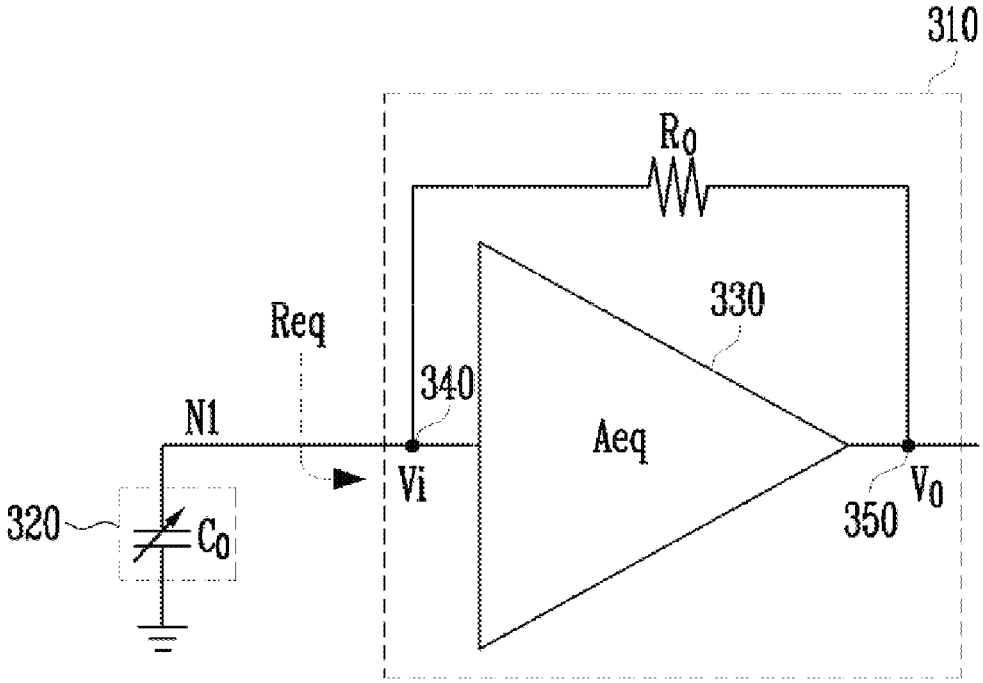
FIG. 3 is a circuit diagram of a read-out circuit according to an exemplary embodiment of the present invention.

FIG. 3 is a circuit diagram of a read-out circuit according to an exemplary embodiment of the present invention. In FIG. 3, a read-out circuit 310 is connected to a capacitor-type microphone 320.

Referring to FIG. 3, the read-out circuit 310 may include an amplification unit 330 and a feedback resistor $R_o$. The amplification unit 330 may linearly amplify a current signal generated by the microphone 320 and may have an amplification gain between 0 and 1. The feedback resistor $R_o$ may be connected between an input terminal 340 and an output terminal 350 of the amplification unit 330.

Since an input impedance $R_{eq}$ of the read-out circuit 310 is defined by Equation 4, the read-out circuit 310 may lead an amplification gain of the amplification unit 330 to approximate 1 so that the read-out circuit 310 can have a high input impedance of several GΩ or higher.

$$Req = Ro \cdot \frac{1}{1 - Aeq} \tag{4}$$

where $R_o$ denotes a resistance of the feedback resistor $R_o$, and $A_{eq}$ denotes an amplification gain of the amplification unit 330.

As can be seen from Equation 4, the read-out circuit 310 may control the input impedance $R_{eq}$ using the amplification gain $A_{eq}$ and the feedback resistance $R_o$.

In this case, since the read-out circuit 310 according to the present invention may lead the amplification gain $A_{eq}$ to approximate 1 so as to obtain a high input impedance $R_{eq}$ of several GΩ or higher, it does not need to include an additional input resistor. Thus, an additional process of forming a resistor with several GΩ is not required.

As described above, the amplification unit 330 has an amplification gain $A_{eq}$ between 0 and 1. In this case, the amplification unit 330 may be, for example, a unity-gain amplifier using an operational amplifier OP Amp.

Figure 4:
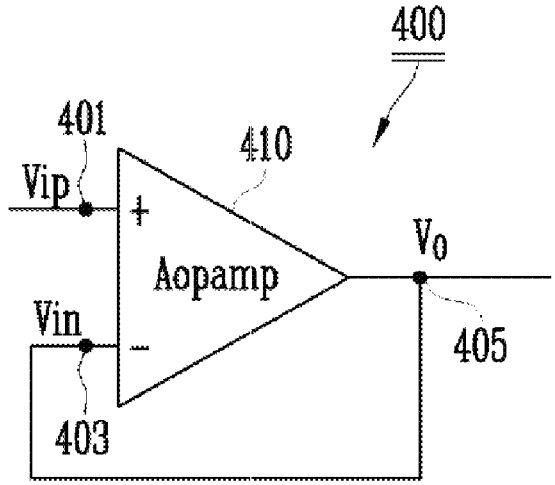
FIG. 4 is a circuit diagram of an example of an amplification unit of the read-out circuit shown in FIG. 3.

FIG. 4 is a circuit diagram of an example of the amplification unit of the read-out circuit shown in FIG. 3. In FIG. 4, the amplification unit 330 is a unity-gain amplifier 400 using an operational amplifier OP Amp.

Referring to FIG. 4, the unity-gain amplifier 400 may include an operational amplifier 410 having an amplification gain $A_{opamp}$. The operational amplifier 410 may include a positive input terminal 401, a negative input terminal 403, and a single output terminal 405. The output terminal 405 of the operational amplifier 410 may be connected to the negative input terminal 403.

The operation of the unity-gain amplifier 400 will now be described. The unity-gain amplifier 400 may receive an input voltage $V_{ip}$ through the positive input terminal 401, amplify the input voltage $V_{ip}$, and output an output voltage $V_o$ having an amplification gain $A_{opamp}$. The output voltage $V_o$ may be fed back to the negative input terminal 403 and amplified again by the operational amplifier 410.

An amplification gain of the unity-gain amplifier 400 is defined by Equation 5:

$$Aeq = \frac{A_{opamp}}{1 + A_{opamp}} \tag{5}$$

where $A_{eq}$ denotes an amplification gain of the unity-gain amplifier 400, and $A_{opamp}$ denotes an amplification gain of the operational amplifier 410.

As can be seen from Equation 5, when the amplification gain $A_{opamp}$ of the operational amplifier 410 is infinite, the amplification gain $A_{eq}$ of the unity-gain amplifier 400 becomes 1. However, the amplification gain $A_{opamp}$ of the operational amplifier 410 is actually a great finite value. Accordingly, as the amplification gain $A_{opamp}$ of the operational amplifier 410 becomes greater, the amplification gain $A_{eq}$ of the unity-gain amplifier 400 becomes closer to but less than 1.

A standard CMOS process enables formation of the operational amplifier 410 having a gain of about $10^5$ or less. Thus, the unity-gain amplifier 400 having an amplification gain that is close to but less than 1 may be embodied. Although it is described that a current standard CMOS process permits the amplification gain of the operational amplifier 410 to reach $10^5$ or less, when a greater amplification gain is embodied with the development of process technology, the unity-gain amplifier 400 may have an amplification gain that is closer to 1.

Furthermore, the gain of the operational amplifier 410 may be greater than 0, and should, preferably but not necessarily, be 10 or more.

Figure 5:
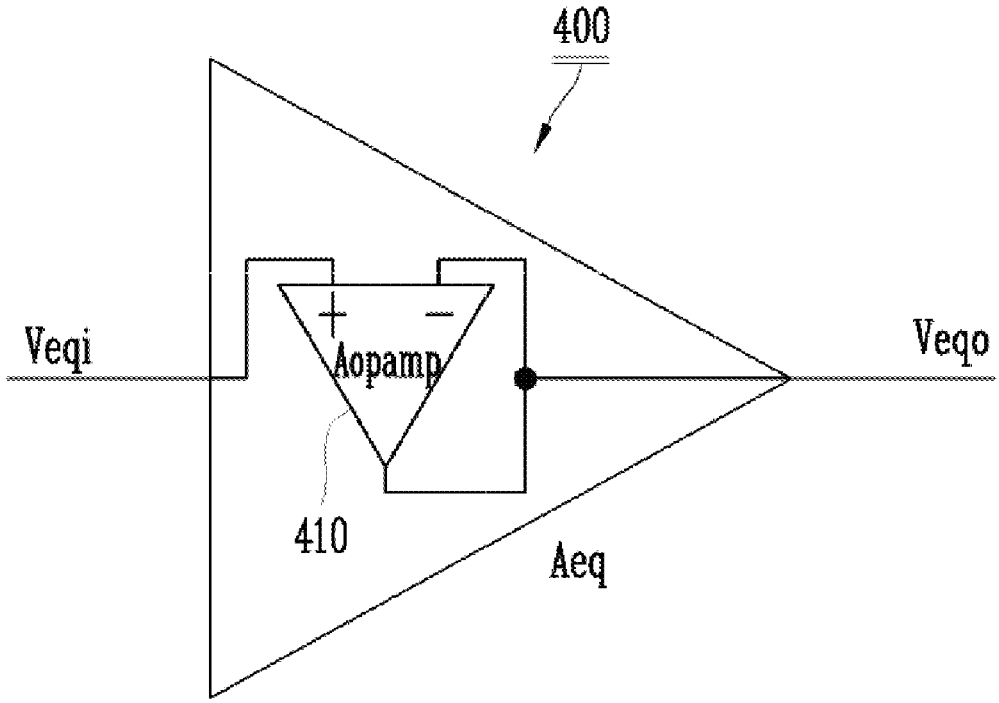
FIG. 5 shows a reconstructed diagram of a unity-gain amplifier shown in FIG. 4.

FIG. 5 shows a reconstructed diagram of the unity-gain amplifier shown in FIG. 4, which simplifies input-output relationships of the unity-gain amplifier.

Referring to FIG. 5, an output voltage $V_{eqo}$ is obtained by amplifying an input voltage $V_{eqi}$ by as much as an amplification gain $A_{eq}$ of the unity-gain amplifier 400. Here, the amplification gain $A_{eq}$ of the unity-gain amplifier 400 is calculated as in Equation 5.

As described above, a read-out circuit according to the present invention employs a resistor and an amplifier that can be manufactured using a standard CMOS process, so that the read-out circuit can be monolithically integrated, thereby reducing manufacturing costs.

Although only a read-out circuit of a microphone is mentioned, the above-mentioned read-out circuit may be applied to any device using an amplifier with a high input impedance.

As explained thus far, a read-out circuit of a microphone according to the present invention can be integrated on a single chip because a preamp with a high input impedance can be formed using a standard CMOS process. As a result, the read-out circuit can be downscaled and integrated at a low cost.

In the drawings and specification, there have been disclosed typical exemplary embodiments of the invention and, although specific terms are employed, they are used in a generic and descriptive sense only and not for purposes of limitation. As for the scope of the invention, it is to be set forth in the following claims. Therefore, it will be understood by those of ordinary skill in the art that various changes in form and details may be made therein without departing from the spirit and scope of the present invention as defined by the following claims.

What is claimed is:

1. A read-out circuit connected to a microphone and configured to linearly amplify a current signal generated by the microphone and output a voltage signal, the read-out circuit comprising:

an amplification unit configured to have an amplification gain that is between 0.5 and 1; and a feedback resistor coupled between input and output terminals of the amplification unit, wherein the amplification unit is configured to have an input impedance satisfying:

$$Req = Ro \cdot \frac{1}{1 - Aeq},$$

where $R_{eq}$ is the input impedance, $R_o$ is a resistance of the feedback resistor, and $A_{eq}$ is the amplification gain of the amplification unit.

2. The read-out circuit according to claim 1, wherein the amplification unit and the feedback resistor are manufactured using a standard CMOS process.

3. The read-out circuit according to claim 1, wherein the amplification unit includes a unity-gain amplifier that has an operational amplifier.

4. The read-out circuit according to claim 3, wherein the operational amplifier includes a positive input terminal, a negative input terminal, and an output terminal, and wherein the output terminal of the operational amplifier is coupled to the negative input terminal.

5. The read-out circuit according to claim 4, wherein the amplification gain of the amplification unit satisfies:

$$Aeq = \frac{A_{opamp}}{1 + A_{opamp}},$$

where $A_{eq}$ is the amplification gain of the amplification unit, and $A_{opamp}$ is an amplification gain of the operational amplifier.

6. The read-out circuit according to claim 5, wherein the amplification gain of the operational amplifier is 10 or more.

* * * * *